US007257845B1

(12) United States Patent
Conner, IV

(10) Patent No.: US 7,257,845 B1
(45) Date of Patent: Aug. 21, 2007

(54) CONVERTIBLE HAT AND PACK APPARATUS

(76) Inventor: William P. Conner, IV, 4925 Crescent Technical Ct., St. Augustine, FL (US) 32086

( * ) Notice: Subject to any disclaimer, the term of this patent is extended or adjusted under 35 U.S.C. 154(b) by 0 days.

(21) Appl. No.: 11/595,531

(22) Filed: Nov. 10, 2006

(51) Int. Cl.
*A42B 1/00* (2006.01)

(52) U.S. Cl. ..... 2/209.12

(58) Field of Classification Search ..... 2/171.1, 2/209.11–209.13
See application file for complete search history.

(56) References Cited

U.S. PATENT DOCUMENTS 2,122,171 A * 6/1938 Alexander ..... 2/209.12
3,505,682 A * 4/1970 Mims ..... 2/171.1
5,214,802 A * 6/1993 McCallum ..... 2/209.12
5,367,713 A * 11/1994 McCallum ..... 2/209.12
5,450,629 A * 9/1995 Gilstrap ..... 2/209.11
5,799,335 A * 9/1998 Ethier ..... 2/209.11
5,845,338 A * 12/1998 Clark ..... 2/195.1
6,070,270 A * 6/2000 De La Torre ..... 2/171.1
6,167,569 B1 * 1/2001 Conner, IV ..... 2/209.11
6,230,331 B1 * 5/2001 Aguilar et al. ..... 2/209.11
6,275,993 B1 * 8/2001 McCarley ..... 2/84
2005/0076420 A1 * 4/2005 Hafif ..... 2/209.13

* cited by examiner

*Primary Examiner*—Katherine Moran
(74) *Attorney, Agent, or Firm*—Arthur G. Yeager

(57) ABSTRACT

A convertible hat that can be used as a cap or fanny pack includes a concave crown portion and brim. A zipper has one portion around the bottom of the crown portion and a second portion around the outside edge of the brim to allow for the formation of a pack. An elastic cord is attached inside the crown portion and stored inside when the hat is used as a cap and located outside when used as a belt to support the hat when used as a pack.

20 Claims, 5 Drawing Sheets

CONVERTIBLE HAT AND PACK APPARATUS

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates generally to multifunctional hat and pack combinations and particularly to a hat apparatus that can be modified for use as a fanny pack apparatus.

2. Related Art

Wearers often desire a hat or ball cap that is convertible to a fanny pack. For example, U.S. Pat. No. 6,167,569 to the present applicant provides an elastic belt that expands to fit around the waist of a user. In addition, the '569 patent includes external belt loops for retaining the belt on the crown or concave portion when the belt is not being used.

BRIEF SUMMARY OF THE INVENTION

In one aspect of the present invention there is provided a convertible hat and pack apparatus comprising a concave crown portion having interior and exterior surfaces and a front portion and a rear portion shaped for placement on a user's head or for forming a pack; the crown portion defines an interior space having a first peripheral edge with terminal ends and first and second peripheral portions; a brim has a third peripheral portion and a fourth peripheral portion with terminal ends, the third peripheral portion being attached to the second peripheral portion securing the brim to the crown portion, the fourth peripheral portion forming an outer edge of the brim.

A releasable cooperating closure fastener has first and second ends attached to the first peripheral portion and the fourth peripheral portion for selectively fastening the concave portion to the brim to form a pack; and an elongate waist cord having opposite ends, each end of the cord being attached to the interior surface of the crown portion at spaced locations the brim. The waist cord is formed of elastic material which is stretched to accommodate a waist of a user. A head band has an inside surface and an outside surface attached to the interior surface of the crown portion and a free edge spaced from the first and second peripheral edge portions of the crown. A pair of spaced slits in the headband provides passage of portions of the waist cord therethrough when the apparatus is configured as a pack. A plurality of spaced fasteners are affixed to and along the inside surface of the head band for securing the waist cord closely adjacent the interior surface of the crown when the apparatus is configured as a hat. The fasteners are hook and loop devices. A releasable cooperating closure fastener includes a zipper having two mating portions each having end portions, one mating portion being affixed to the first peripheral portion, another portion being affixed to the fourth peripheral portion.

Other aspects of the invention include mating portions being located respectively on the first and fourth peripheral portions to provide respective end portions of the mating portions terminating on the respective first and fourth peripheral portion spaced away from the respective terminal ends of the mating portions to provide a pair of spaced openings for passage of the waist cord therethrough when the zipper is closed to configure the apparatus as a pack. Each releasable fastener includes an elongate member having one end affixed to one surface of the headband and a free end releasably attachable to the one end of the member to form a loop for carrying a portion of the waist cord therein. The waist cord is folded onto itself when the apparatus is configured as a cap, the folded over waist cord being captured and retained by at least two of the fasteners.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
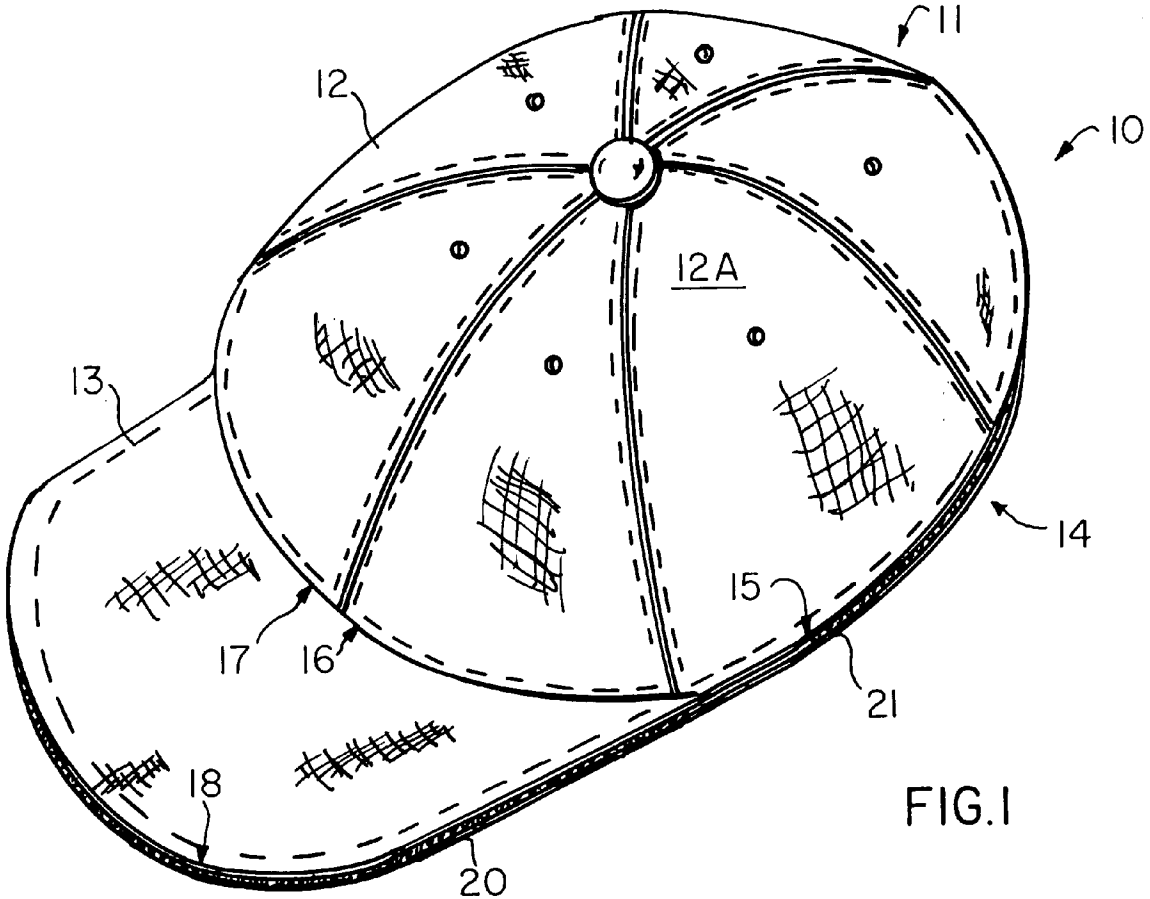
FIG. 1 is a perspective view of the hat/fanny pack in a cap configuration in accord with the present invention.

With respect to the drawing, FIG. 1 shows the cap/fanny pack 10 combination configured as a hat or cap 11. The cap 11 includes a concave crown portion 12 and a brim 13.

The cap 11 includes a first peripheral edge 14 for placement of a user's head. The first peripheral edge 14 includes a first peripheral portion 15 and a second peripheral portion 16. Brim 13 is attached to crown portion 12 at second peripheral portion 16.

Brim 13 is formed of cotton and encloses a panel of rigid material to maintain the shape and is further defined by a third peripheral portion 17 and a fourth peripheral portion 18 forming an outer edge of brim 13. Third peripheral portion 17 is preferably attached to second peripheral portion 16 by conventional stitching.

Figure 2:
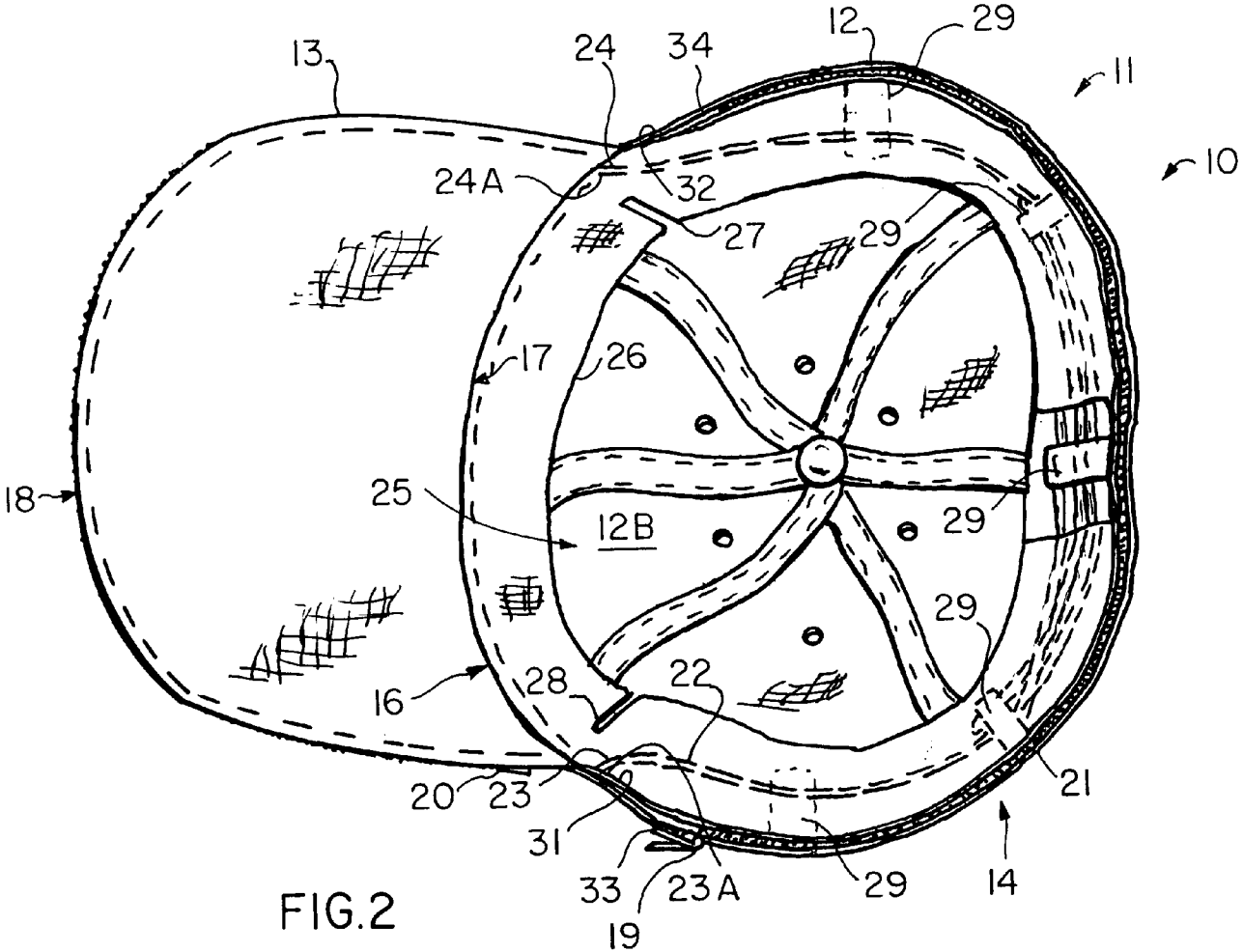
FIG. 2 is a bottom view of the cap configuration of FIG. 1 with a portion of the head band cutaway to show a fastener loop.

The convertible apparatus 10 has a zipper fastener 19 attached to first peripheral edge 14 and the fourth peripheral portion 18 of brim 13 for connecting first peripheral edge 14 to fourth peripheral portion 18. The zipper fastener 19 has mating portions 20, 21. Portion 20 is attached to fourth peripheral portion 18 and portion 21 attached to first peripheral portion 15. FIG. 1 illustrates the zipper 19 unfastened and disconnected at its origin for use of the apparatus as a cap 11. As shown in FIG. 2, crown portion 12 includes exterior and interior surfaces 12A, 12B, and is further defined by an elastic cord 22 attached at first 23 and second ends 24 attached at spaced locations 23A, 24A in the interior space 25 with an elongate head band 26 extending adjacent the peripheral edge 14 inside the zipper portion 21. Two spaced slits 27 and 28 are formed adjacent the ends 23 and 24. A plurality of fasteners, preferably five Velcro loops 29, are mounted in interior space 25 preferably spaced around and to rearward portion of the inside surface of the head band 26 to secure folded cord 22 between crown portion 12 and head band 26. Neither loops 29 nor the head band 26 are visible when apparatus 10 is configured as a cap 11.

The zipper portion 20 is attached to fourth peripheral portion 18 at a position slightly inwardly of the outermost edge of brim 13 to minimize the physical appearance of zipper portion 20. Similarly, zipper portion 21 is preferably attached slightly disposed above the lowermost edge of first peripheral portion 15 and between the lowermost edge of headband 26. Zipper 19 is accordingly much less visible in the present apparatus than the zipper in the '569 patent discussed hereinabove.

Figure 3:
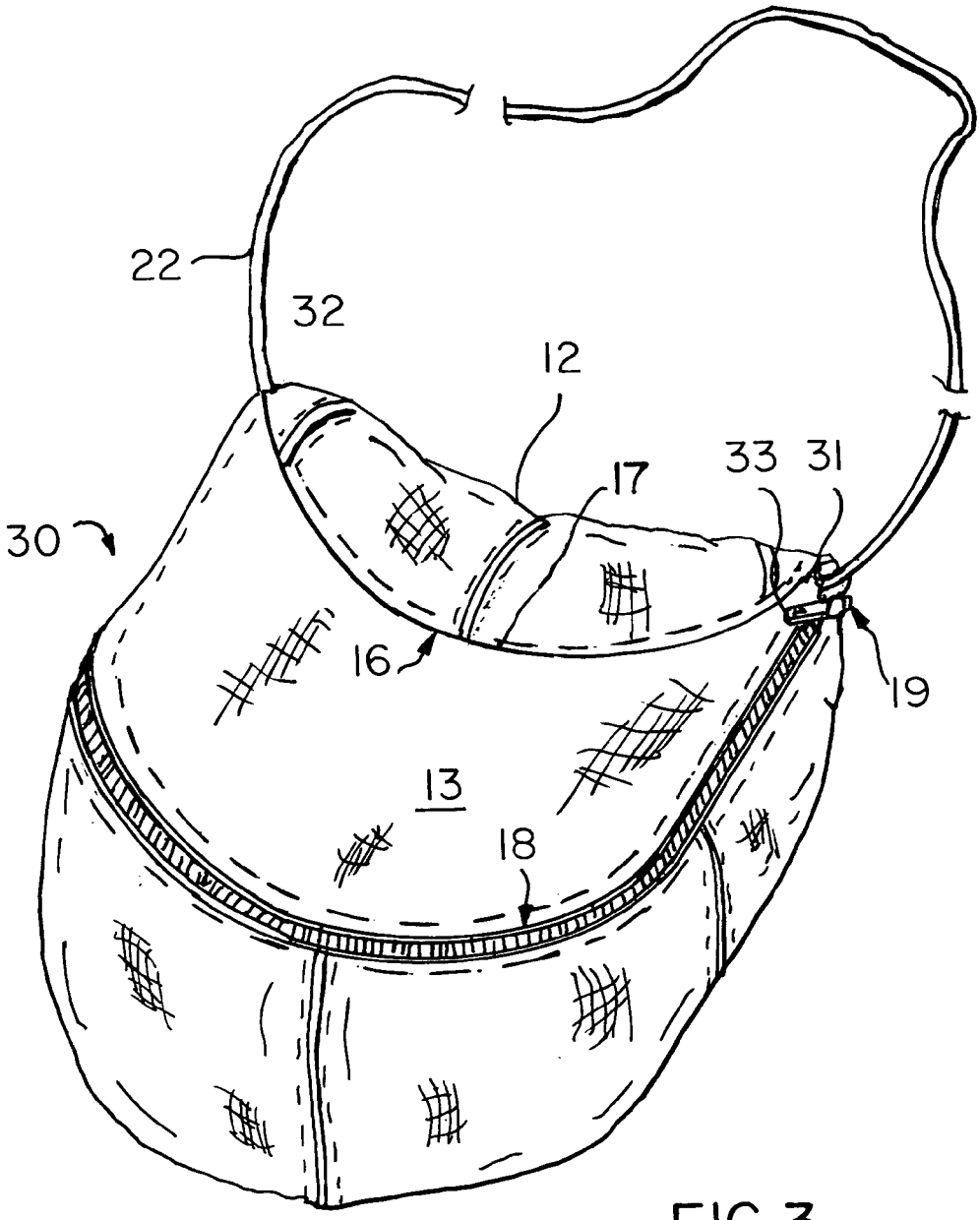
FIG. 3 is a perspective view of the hat/fanny pack in a fanny pack configuration in accord with the present invention.
Figure 4:
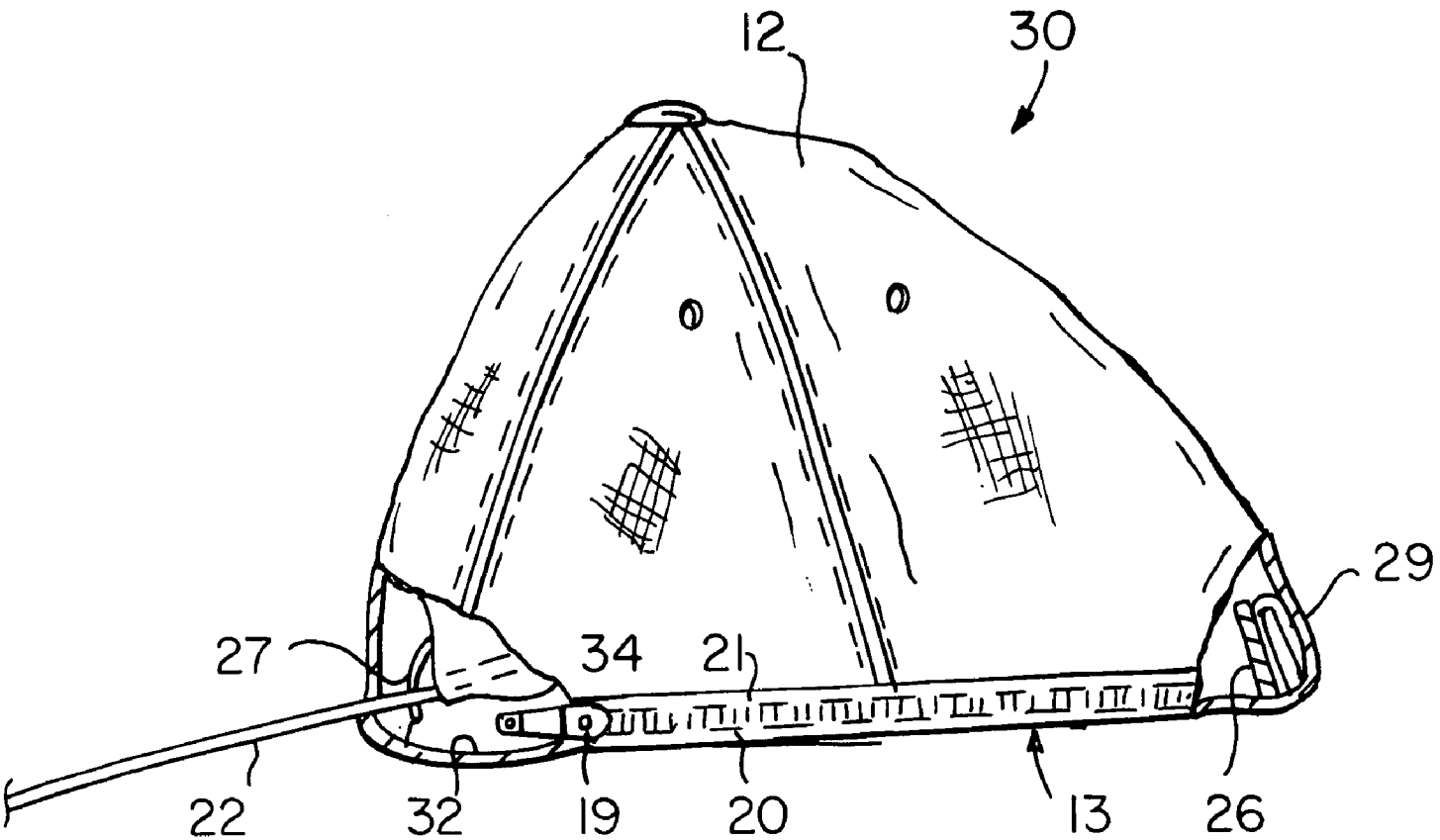
FIG. 4 is a side view of the fanny pack configuration of FIG. 3 with a portion cutaway to show a fastener loop.
Figure 5:
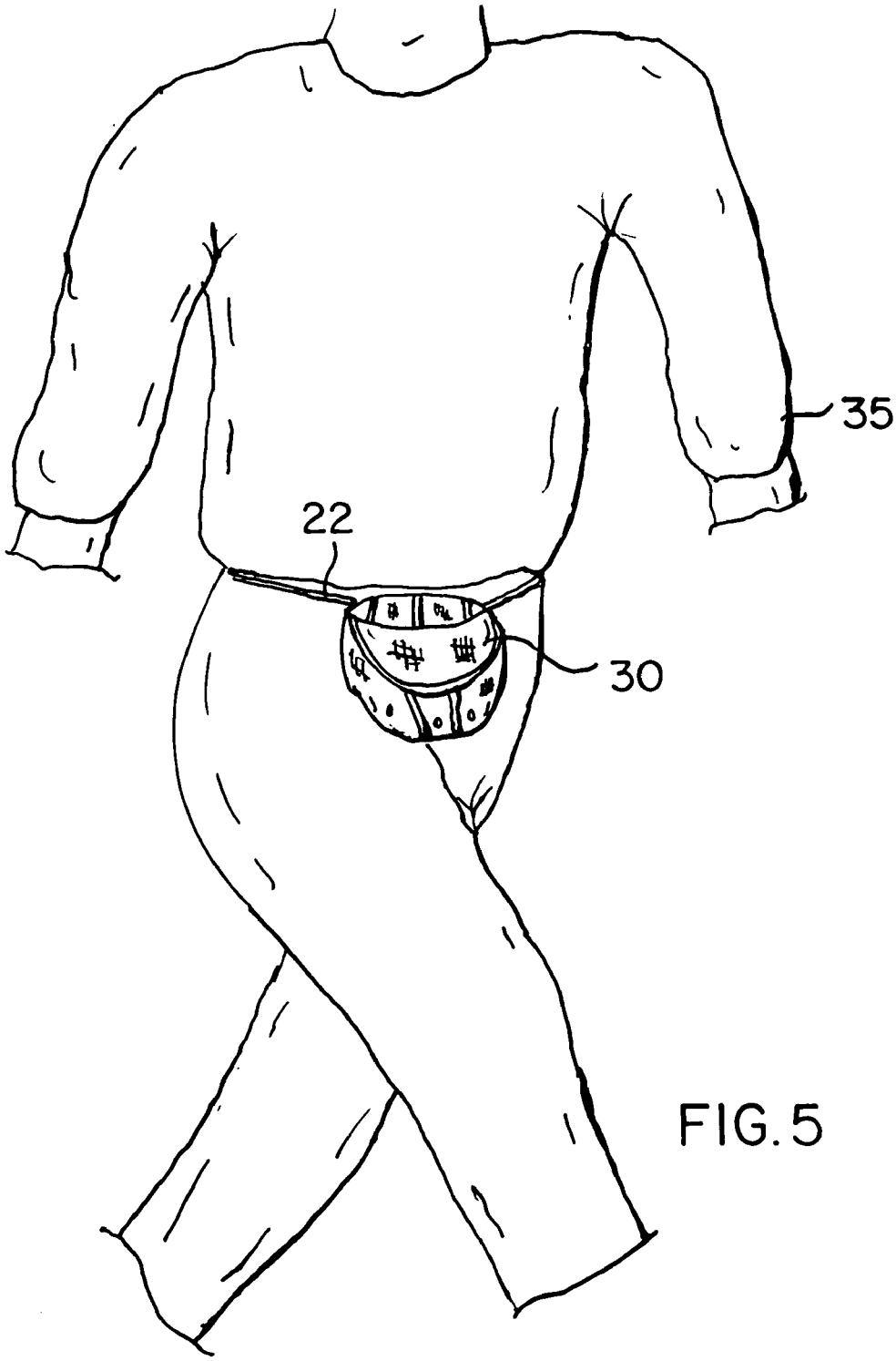
FIG. 5 is a pictorial view of the fanny pack of FIGS. 3, 4 being worn by a user.

FIG. 3 illustrates the apparatus configured as a fanny pack 30 formed by folding crown portion 12 against brim 13. The zipper portions 20, 21 are attached together and fastened around the length to form pouch 30. Cord 22 has been removed from loops 29 and positioned through respective slits 27 and 28 and out of openings 31 and 32 defined at respective terminal ends 33 and 34 of zipper 19. The pack 30 is shown being worn by user 35 in FIG. 5.

Crown portion 12 is made of cotton and brim is also made of cotton and includes an insert (not shown) to increase the rigidity thereof as understood in the art.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A convertible hat and pack apparatus comprising a concave crown portion having interior and exterior surfaces and a front portion and a rear portion shaped for placement on a user's head or for forming a pack;

said crown portion defining an interior space having a first peripheral edge with terminal ends and first and second peripheral portions;

a brim having a third peripheral portion and a fourth peripheral portion with terminal ends, said third peripheral portion being attached to said second peripheral portion securing said brim to said crown portion, said fourth peripheral portion forming an outer edge of said brim;

a releasable cooperating closure fastener having first and second ends attached to said first peripheral portion and said fourth peripheral portion for selectively fastening said concave portion to said brim to form a pack; and an elongate waist cord having opposite ends, each said end of said cord being attached to said interior surface of said crown portion at spaced locations adjacent said brim.

2. The apparatus as defined in claim 1 wherein said waist cord is formed of elastic material which is stretched to accommodate a waist of a user.

3. The apparatus as defined in claim 1 further including a head band having an inside surface and an outside surface attached to said interior surface of said crown portion and a free edge spaced from said first and second peripheral edge portions of said crown.

4. The apparatus as defined in claim 3 further including a pair of spaced slits in said headband for passage of portions of said waist cord therethrough when said apparatus is configured as a pack.

5. The apparatus as defined in claim 3 further including a plurality of spaced fasteners affixed to and along said inside surface of said head band for securing said waist cord closely adjacent said interior surface of said crown when said apparatus is configured as a hat.

6. The apparatus as defined in claim 5 wherein said fasteners are hook and loop devices.

7. The apparatus as defined in claim 1 further including a plurality of spaced fasteners located inside said interior space of said crown portion for securing said waist cord inside and adjacent said interior space of said crown when said apparatus is configured as a hat.

8. The apparatus as defined in claim 1 wherein said releasable cooperating closure fastener includes a zipper having two mating portions each having end portions, one said mating portion being affixed to said first peripheral portion, another said mating portion being affixed to said fourth peripheral portion.

9. The apparatus as defined in claim 8 wherein said mating portions are located respectively on said first and fourth peripheral portions to provide respective said end portions of said mating portions terminating on said respective said first and fourth peripheral portion spaced away from respective said terminal ends of said mating portions to provide a pair of spaced openings for passage of said waist cord therethrough when said zipper is closed to configure said apparatus as a pack.

10. The apparatus as defined in claim 5 wherein each said releasable fastener includes an elongate member having one end affixed to said one surface of said headband and a free end releasably attachable to said one end of said member to form a loop for carrying a portion of said waist cord therein.

11. The apparatus as defined in claim 10 wherein said waist cord is folded onto itself when said apparatus is configured as a cap, said folded over waist cord being captured and retained by at least two said fasteners.

12. A convertible hat and pack apparatus comprising:

a concave crown portion having interior and exterior surfaces and front and rear portions shaped for placement on a user's head or for forming a pack;

said crown portion defining an interior space having a first peripheral edge with terminal ends and first and second peripheral portions;

a brim having a third peripheral portion and a fourth peripheral portion with terminal ends, said third peripheral portion being attached to said second peripheral portion for securing said brim to said crown portion, said fourth peripheral portion forming an outer edge of said brim;

a zipper having first and second ends attached to said first peripheral portion and said fourth peripheral portion for selectively fastening said concave portion to said brim to form a pack;

a waist cord having opposite ends, each said end of said cord being attached to said crown portion at spaced locations adjacent said brim;

an elongate headband attached to and around said crown portion.

13. The apparatus as defined in claim 12 further including a plurality of releasable fasteners located inside said interior space of said crown portion for securing said waist cord closely adjacent said crown portion when said apparatus is configured as a hat.

14. The apparatus as defined in claim 13 further including a circumferential headband attached around said crown portion, said plurality of fasteners being located between said headband and said interior surface of said crown portion.

15. The apparatus as defined in claim 14 further including a pair of spaced slits in said headband for passage of portions of said waist cord therethrough when said apparatus is configured as a pack.

16. The apparatus as defined in claim 14 wherein said zipper has two mating portions each having end portions, one said mating portion affixed to said first peripheral portion, other said mating portion affixed to said fourth peripheral portion.

17. The apparatus as defined in claim 15 wherein said mating portions are located on respective said first and fourth peripheral portions to provide respective said end portions of said mating portions terminate on said respective said first and peripheral portion spaced away from respective said terminal ends of said mating portions to provide a pair of spaced openings for passage of said waist cord therethrough when said zipper is closed to configure said apparatus as a pack.

18. The apparatus as defined in claim 13 wherein said headband has one surface adjacent said crown portion with an edge portion affixed to said crown portion and a free edge portion.

19. The apparatus as defined in claim 18 wherein each said releasable fastener includes an elongate member having one end affixed to said one surface of said head band and a free end releasably attachable to said one end of said member to form a loop for carrying a portion of said waist cord therein.

20. The apparatus as defined in claim 19 wherein said waist cord is folded onto itself when said apparatus is configured as a cap, said folded over waist cord being captured and retained by at least two said fasteners.

* * * * *